United States Patent [19]

Marker et al.

[11] 4,273,062

[45] Jun. 16, 1981

[54] DEVICE FOR CONNECTING A SAILMAST TO A SAILBOARD

[75] Inventors: Hannes Marker, Hauptstrasse 51-53, 8100 Garmisch-Partenkirchen, Fed. Rep. of Germany; Otto Hüss, Wallgau, Fed. Rep. of Germany

[73] Assignee: Hannes Marker, Garmisch-Partenkirchen, Fed. Rep. of Germany

[21] Appl. No.: 24,996

[22] Filed: Mar. 29, 1979

[30] Foreign Application Priority Data

Oct. 5, 1978 [DE] Fed. Rep. of Germany ..... 2843551

[51] Int. Cl.[3] ..... B63B 15/00

[52] U.S. Cl. ..... 114/91

[58] Field of Search ..... 9/310 E; 114/39, 89, 114/90, 91, 102, 111, 204, 205

[56] References Cited

U.S. PATENT DOCUMENTS

| | | | |
|---|---|---|---|
| 3,195,494 | 7/1965 | Robin | 114/39 |
| 3,827,386 | 8/1974 | Faden | 114/91 |
| 4,037,553 | 7/1977 | Marker | 9/310 E X |
| 4,073,254 | 2/1978 | Marker | 114/39 |
| 4,107,806 | 8/1978 | Newland et al. | 9/310 E |

FOREIGN PATENT DOCUMENTS

| | | | |
|---|---|---|---|
| 7811332 | 5/1979 | Netherlands | 9/310 E |

*Primary Examiner*—Sherman D. Basinger
*Attorney, Agent, or Firm*—Fleit & Jacobson

[57] ABSTRACT

A mast-connecting universal joint is provided, which is connected at one end to the mast and is permanently fixed thereto or can be only arbitrarily separated therefrom, and which is connected at its other end to a supporting member, which is biased by a resilient element and in position for use is positively held in a slide, which is longitudinally slidably guided and adapted to be resilient locked in a groove of the sailboard. The resilient element constitutes a return spring for the supporting member when the mast is in any position of use, and a return spring for moving the longitudinally slidable slide to a position in which the slide is releasably locked.

15 Claims, 5 Drawing Figures

Figure 1:
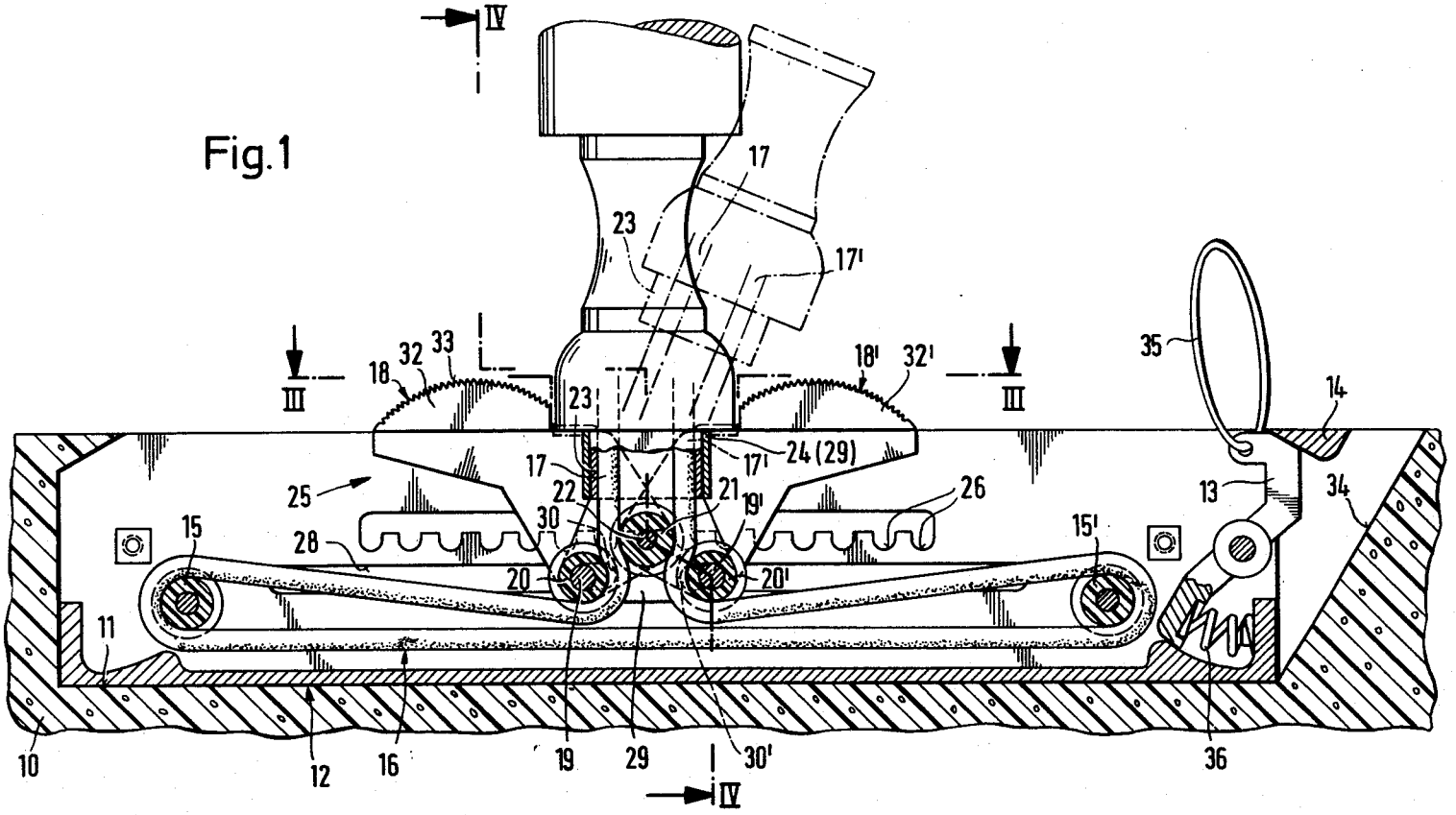

Fig. 3
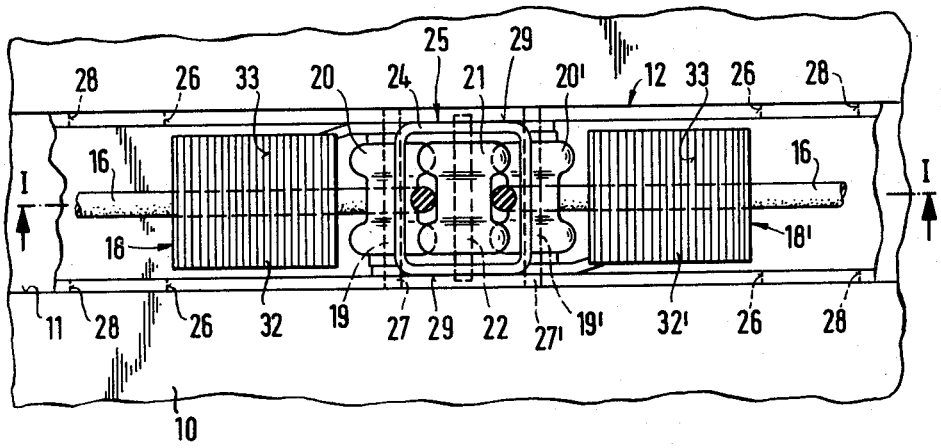
Fig. 4
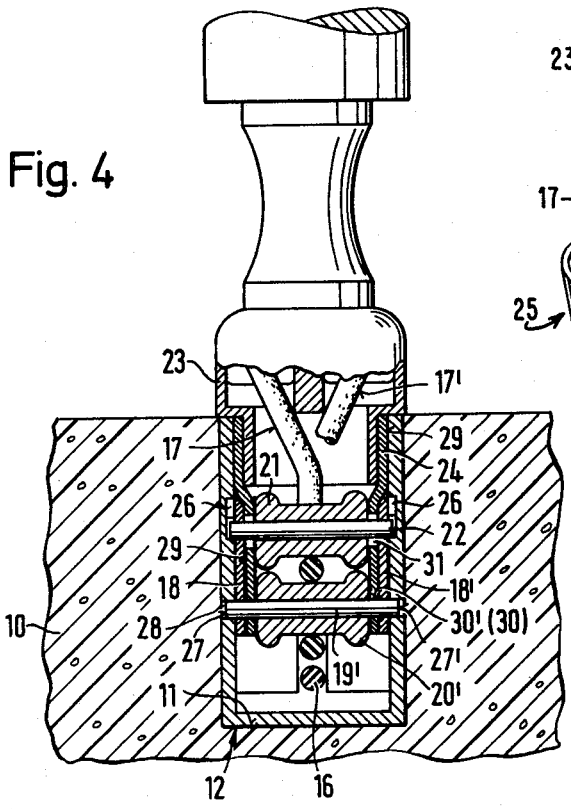
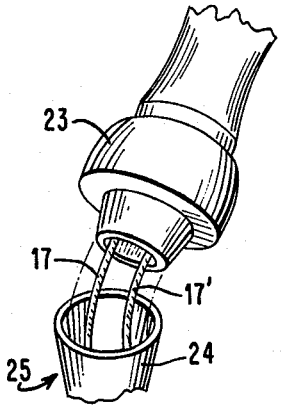
Fig. 5

DEVICE FOR CONNECTING A SAILMAST TO A SAILBOARD

This invention relates to a device for connecting a sailmast to a sailboard, comprising a mast-connecting universal joint, which is connected at one end to the mast and is permanently fixed thereto or can be only arbitrarily separated therefrom, and which is connected at its other end to a supporting member, which is biased by a resilient element and in position for use is positively held in a slide, which is longitudinally slidably guided and adapted to be resiliently locked in a groove of the sailboard.

A known device comprises a supporting member, which carries the mast and is biased by a resilient element and in position for use is positively retained in a mating recess of the sailboard. That supporting member is used to serve as a safety overload clutch, which is disengaged when the universal joint permits the mast to be turned down to a position in which it clamps an organ of a human body.

It is also known to provide a device for shifting the mast between at least two positions in the longitudinal direction of the sailboard. An essential feature of that device resides in that the resiliently locked mast must be raised when it is to be shifted to another position, in which the mast is resiliently locked too. This is considered a disadvantage because the vertical raising of the mast requires a large effort and the surfer must hold the mast, when it is in a position of unstable equilibrium.

It is an object of the invention to provide an overload clutch for the mast in combination with easily operable means for shifting the mast in the longitudinal direction of the sailboard.

In accordance with the invention, this is accomplished in that the resilient element constitutes a return spring for the supporting member when the mast is in any position of use, and a return spring for moving the longitudinally slidable slide to a position in which the slide is releasably locked. Where this feature of the invention is provided for and in the embodiments thereof which are defined in sub-claims, two essential features are obtained. In the first place, only a small space is required in the sailboard body because a single part is used for two functions. This small space requirement contributes to the strength and stiffness which are significant for a surfboard. On the other hand, the spring is used with the same release characteristic in all mast positions. Another advantage resides in that the use of equal results in a device which is inexpensive and not liable to be deranged.

The detent recesses and guide grooves for the slide elements may be provided in the form of a longitudinal groove in the board itself or, according to a preferred feature of the invention, in a box which receives the carriage, the supporting member and the spring and which is adapted to be slidably fitted, and resiliently locked in a slot of the sailboard. With this feature the device according to the invention can easily be installed and removed at any time so that any repairs or cleaning work will be greatly facilitated. Besides, a complicated machining of the bulky sailboard is not required.

According to another feature of the invention the slide comprises a receiver for the supporting member and pedals, which are connected to the slide on both sides thereof and are movable relative to it in slots and are guided by means of pins in grooves formed in the sides of the sailboard groove or of the inserted box.

According to a preferred further feature of the invention, the receiver for the supporting member is here integrated in the slide.

According to another important feature of the device according to the invention the spring consists of an elastic rope or the like, which is trained around rollers, which are rotatably mounted in the end portions of the groove or box and in the pedals, and the two ends of the rope are connected to the supporting member.

The pretensioned elastic endless rope trained around rollers provides for an always constant force tending to retain the slide in position and for an always equal release characteristic for the supporting member.

According to an important feature of the invention, the slide is released in that a pedal is depressed and the slide can be longitudinally displaced by being pushed with the foot. This represents a very important advantage over known devices because the pedal is anyway close to the surfer's foot and he need no longer shift the mast by means of the two hands, which are required to control the gaff. Another advantage to which other features of the invention contribute resides in that the mast retains a stable position even when it has been shifted.

According to a further feature of the invention the supporting member and the receiver associated with it may be conical so that a canting during a safety release will be avoided. According to a further feature the taper of the supporting member and receiver may be adjustable in steps or infinitely.

The groove formed in the sailboard for receiving the slidably fitted box suitably has a bevelled surface at least at one end so that sand and other impurities can easily be removed.

Further features and advantages of the invention are apparent from the claims, the drawings and the subsequent description.

Figure 2:
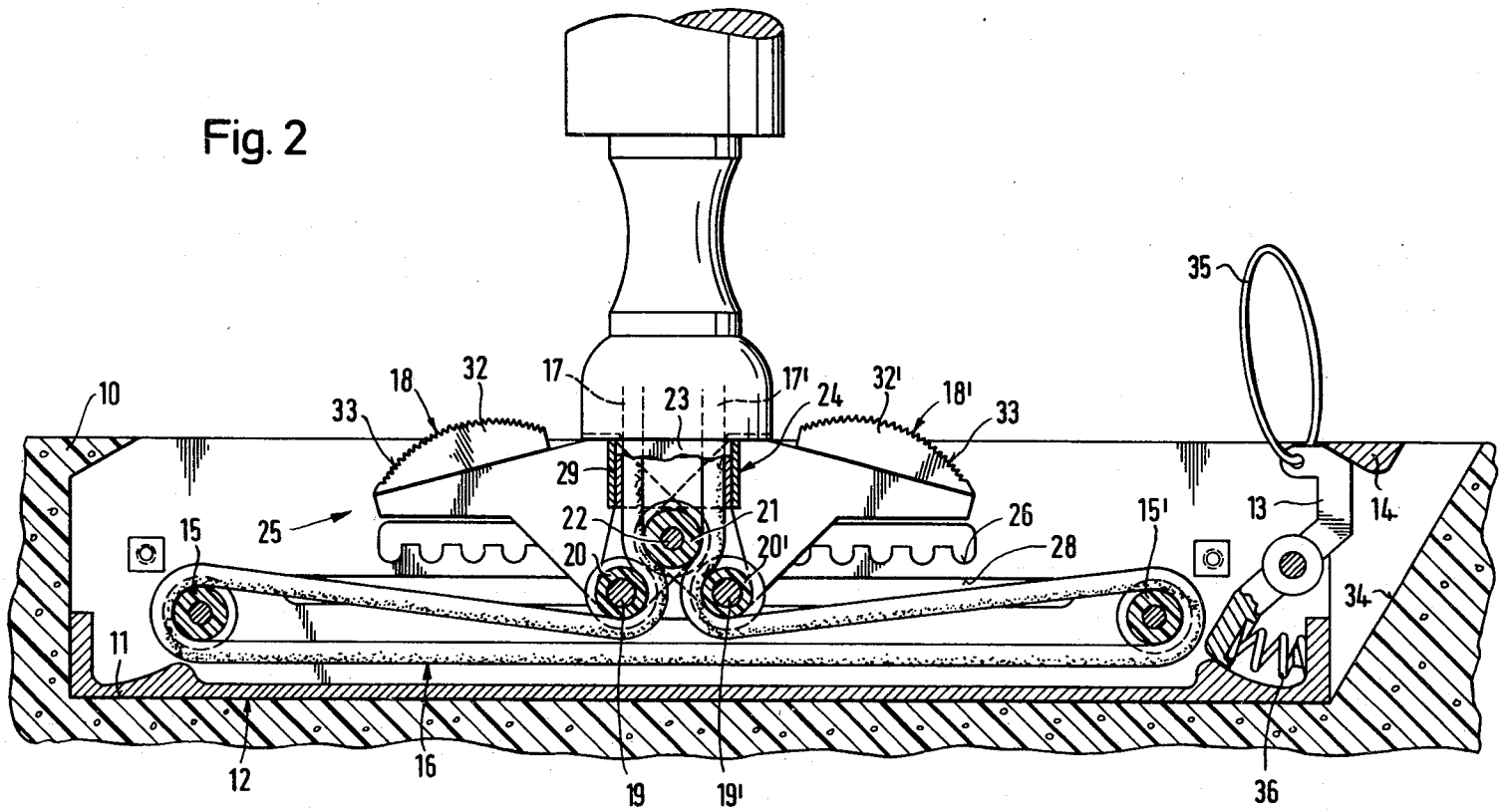

An illustrative embodiment of the invention is shown on a plurality of drawings, in which FIG. 1 is a longitudinal sectional view showing the device with the supporting member resiliently locked and released and with the resiliently locked slide, FIG. 2 is a longitudinal sectional view showing the device with the slide released, FIG. 3 is a top plan view showing the device partly in horizontal section taken on line III—III in FIG. 1, FIG. 4 is a vertical longitudinal sectional view taken on line IV—IV in FIG. 1, and FIG. 5 is a partial perspective illustrating the shape of a supporting member and associated slide used in one embodiment of the present invention.

The drawings show a portion of a sailboard 10, which has a longitudinal groove 11, in which a box 12 is slidably fitted. The box 12 is provided at one end with a pawl 13 for interengaging with a detent recess 14 in the sailboard. Rollers 15, 15' are rotatably mounted on axles in the end portions of the box 12. A spring 16 consisting, e.g., of an elastic rope is trained around said rollers and at its free ends 17, 17' is trained on both sides around rollers 20, 20', which are rotatably mounted on pins 19, 19' in the lower portions of pedals 18, 18' and around a roller 21, which is common to both pedals, into the supporting member 23 and is firmly anchored therein. The roller 21 is mounted on a locking pin 22. The supporting member 23 has an upper portion connected to the lower end of a mast-connecting universal joint (not illustrated). The upper end of the joint is connected to the mast M either permanently or in such manner that it can be only arbitrarily separated therefrom. The supporting member 23 is disposed in a receiving portion 24 of the slide 25, which also receives the pedals 18, 18'. The latter are interconnected by the locking pin 22, which can be resiliently locked in one of the lateral openings 26 of the box 12. The pins 19, 19' which are mounted in the lower portions of the pedals and carry the rollers 20, 20' have extended end portions 27, 27', which are received by lateral grooves 28 in the box 12 and serve to guide the pedals in the longitudinal direction. The pins 19, 19' extend through slots 30, 30' in the side walls 29 of the receiving portion 24 and are thus laterally movable in the grooves 28. Each side wall 29 of the receiving portion 24 has in its upper portion an approximately triangular hole 31, through which the locking pin 22 extends so that said locking pin is movable in all directions when the slide 25 is to be released, longitudinal displaced, and re-locked.

The pedals 18, 18' have foot-engaging portions 32, 32', which protrude from the surface of the sailboard and have a profiled surface 33. When a foot is used to apply vertical pressure to the pedals and then to push them laterally, the slide 25 will be released and a longitudinal shifting of the entire mastcarrying device will be initiated. The longitudinal groove 11 which is formed in the sailboard 10 and receives the box 12 is formed at one end with an inclined surface 34, which facilitates the removal of sand and other foreign matter. To permit the box 12 to be lifted from the groove 11, the pawl 13 is provided with a tensile element 35, such as a loop, which is operable against the force of a compression spring 36.

FIG. 2 shows the device according to the invention when the slide has been unlocked for a shifting of the mast in the longitudinal direction of the sailboard.

What is claimed is:

1. A device for connecting a sailmast to a sailboard comprising:

a supporting member connected to the sailmast;

a slide for positively holding the supporting member in a position for use;

a resilient element for biasing the supporting member towards the slide to the position for use;

the sailboard having a longitudinal groove formed therein for receiving the slide, the slide being longitudinally slidably guided and adapted to be releasably locked in the groove;

said resilient element urging the supporting member towards the slide when the sailmast is in any position of use and urging said slide to a position in which said slide is releasably locked.

2. A device according to claim 1, characterized in that the device further comprises a sailboard box releasably held in said groove, and in that the slide comprises a receiver for the supporting member, pedals, and pins connected to the pedals for guiding movement of portions of the pedals with respect to the slide, the pedals extending on both sides of the slide, the pins being movable relative to the slide in slots and being received in grooves formed in sides of the sailboard box for guiding movement of said pedals.

3. A device according to claim 1, characterized in that the device further comprises a box locked in the groove of the sailboard, the box having a pawl arbitrarily releasable from a portion of the groove to facilitate separation of the box from the groove.

4. A device according to claim 1, further comprising a box receiving said slide and said resilient element, said box being slidably fitted in said groove; and means for releasably locking said box in said groove.

5. A device according to claim 4, wherein the means for releasably locking said box in said groove comprises a pawl provided on the box, the pawl being arbitrarily releasable from a portion of the groove to facilitate separation of the box from the groove.

6. A device according to claim 4, characterized in that the slide comprises a receiver for the supporting member, pedals, and pins connected to the pedals for guiding movement of portions of the pedals with respect to the slide, the pedals extending on both sides of the slide, the pins being movable relative to the slide in slots and being received in grooves formed in sides of the inserted box for guiding movement of said pedals.

7. A device according to one of claims 2, or 6, characterized in that the pedals are interconnected by a common locking pin and are mounted thereon to be pivotally movable independently of each other and the pin is adapted to be locked in apertures in the box and to be released therefrom.

8. A device according to one of claims 2, or 6, characterized in that the pedals have foot-engageable portions which are disposed above the surface of the sailboard and provided with a profiled surface.

9. A device according to one of claims 1, or 4, characterized in that the slide is adapted to be unlocked in that a pedal is depressed so that the slide is then longitudinally slidable.

10. A device according to one of claims 1, or 4, characterized in that the supporting member and a receiver in the slide for the supporting member are conical.

11. A device according to one of claims 2, 1, 4, or 6, characterized in that the groove in the board has an inclined surface at least at one end.

12. A device according to one of claims 2, or 6 characterized in that said resilient element comprises an elastic rope, said device further comprising rollers rotatably mounted in end portions of the box and in the pedals, said resilient element being trained around said rollers and having ends connected to the supporting member.

13. A device according to claim 2 or 6, characterized in that the slide is adapted to be unlocked when one of said pedals is depressed so that the slide is then longitudinally slidable.

14. A device according to claim 2 or 6, characterized in that the supporting member and the receiver in the slide are conical.

15. A device according to claim 2 or 6, characterized in that the device further comprises a pawl provided on the box, the pawl being arbitrarily releasable from a portion of the groove to facilitate separation of the box from the groove.

* * * * *